US009848694B2

(12) United States Patent
Hauger

(10) Patent No.: US 9,848,694 B2
(45) Date of Patent: Dec. 26, 2017

(54) PROTECTED TRANSPORT OF AN APPLICATOR

(71) Applicant: GEKA GmbH, Bechhofen (DE)

(72) Inventor: Christian Hauger, Donaueschingen (DE)

(73) Assignee: Geka GmbH, Bechhofen (DE)

( * ) Notice: Subject to any disclaimer, the term of this patent is extended or adjusted under 35 U.S.C. 154(b) by 562 days.

(21) Appl. No.: 14/540,245

(22) Filed: Nov. 13, 2014

(65) Prior Publication Data

US 2015/0135648 A1 May 21, 2015

(30) Foreign Application Priority Data

Nov. 17, 2013 (DE) ..... 10 2013 113 107

(51) Int. Cl.

| | |
|---|---|
| ***A45D 40/26*** | (2006.01) |
| ***A45D 34/04*** | (2006.01) |
| ***A46B 17/04*** | (2006.01) |
| ***A45D 40/18*** | (2006.01) |

(52) U.S. Cl.

CPC ..... *A46B 17/04* (2013.01); *A45D 40/18* (2013.01); *A45D 40/265* (2013.01); *A45D 40/267* (2013.01); *A46B 2200/1053* (2013.01)

(58) Field of Classification Search

CPC ..... A45D 40/00; A45D 45/00

See application file for complete search history.

(56) References Cited

U.S. PATENT DOCUMENTS

| | | | | |
|---|---|---|---|---|
| 4,470,425 A * | 9/1984 | Gueret | ..... | A45D 40/267 132/218 |
| 4,506,489 A * | 3/1985 | Schieser | ..... | B65B 7/2807 53/281 |
| 5,121,763 A * | 6/1992 | Kingsford | ..... | A45D 40/28 132/317 |

(Continued)

FOREIGN PATENT DOCUMENTS

| | | |
|---|---|---|
| DE | 10 2009 057 026 A1 | 6/2011 |
| DE | 10 2011 089 896 A1 | 6/2012 |
| WO | 02/39845 A1 | 5/2002 |

OTHER PUBLICATIONS

European Search Report dated Jul. 2, 2015 in related European application EP 14191726.0-1659.

(Continued)

*Primary Examiner* — Andrew M Tecco
*Assistant Examiner* — Praachi M Pathak
(74) *Attorney, Agent, or Firm* — Polson Intellectual Property Law, PC; Margaret Polson

(57) ABSTRACT

A method for transporting cosmetic applicator units, which are not assembled with their cosmetic receptacles, in bulk form to a destination at which they are assembled with the associated cosmetic receptacles so that the respective wiper associated with the cosmetic applicator, before the stowing of the cosmetic applicator unit, is slid at least partially over the bristle set of the applicator part so that it at least partially contains the bristle set and remains there for the duration of the transport and/or remains in this position during storage; a plurality of cosmetic applicator units that are protected in this way are stowed together in a container and then transported to their destination and/or are stored until ready for further use.

11 Claims, 2 Drawing Sheets

(56) References Cited

U.S. PATENT DOCUMENTS 5,349,972 A * 9/1994 Dirksing ..... A45D 40/267 132/218
5,397,193 A * 3/1995 Kirk, III ..... A45D 40/267 401/122
5,720,563 A * 2/1998 Nakagawa ..... A46B 11/001 401/119
5,794,632 A * 8/1998 Gueret ..... A45D 40/265 132/218
6,264,390 B1 * 7/2001 Lee ..... A45D 40/268 401/121
6,371,129 B1 * 4/2002 Le Bras-Brown ... A45D 34/043 132/218
6,505,631 B2 * 1/2003 Fischer ..... A45D 40/267 132/218
6,718,990 B1 * 4/2004 Chastain ..... A45D 40/026 132/218
7,097,376 B2 * 8/2006 Beretta ..... A45D 40/267 401/121
7,278,798 B1 * 10/2007 Kearney ..... A45D 40/267 401/121
7,448,393 B2 * 11/2008 Beak ..... A45D 34/045 132/218
7,866,327 B1 * 1/2011 Gueret ..... A45D 34/046 132/218
7,946,778 B2 * 5/2011 Gueret ..... A45D 40/268 401/122
8,403,580 B2 * 3/2013 De Laforcade ..... A45D 40/267 401/122
8,944,713 B2 * 2/2015 Koguchi ..... A45D 40/205 401/126
9,179,757 B2 * 11/2015 Mathiez ..... A45D 40/264
9,357,827 B2 * 6/2016 Grabo ..... A45D 40/24
9,538,829 B2 * 1/2017 Chung ..... A45D 40/267
2003/0000543 A1 * 1/2003 Kim ..... A45D 34/043 132/313

OTHER PUBLICATIONS

German Search Report in related German application DE 10 2013 113 107.7.

* cited by examiner

PROTECTED TRANSPORT OF AN APPLICATOR

CROSS REFERENCE APPLICATIONS

This application claims the benefit of German Application No. 10 2013 113 107.7 filed Nov. 17, 2013, which is incorporated herein by reference for all purposes.

BACKGROUND

Cosmetic units of the kind in question here are usually composed of a cosmetic receptacle that is filled with a cosmetic into which a cosmetic applicator is dipped. The cosmetic applicator is typically attached with the aid of a wand to a handle that generally also constitutes the closure of the cosmetic unit. In order to be able to apply cosmetic, the closure is unscrewed or withdrawn from the cosmetic receptacle and the cosmetic applicator is pulled through a wiper and out of the cosmetic receptacle. The wiper ensures that the cosmetic applicator is loaded with approximately the desired amount of cosmetic, permitting an application of cosmetic that provides sufficient coverage, but is clump-free.

Cosmetic units of this kind are typically manufactured in a cooperative fashion. The companies that specialize in the manufacture of the actual cosmetic applicators are not usually also involved in manufacturing the cosmetic compound as such and then dispensing the cosmetic compound into the corresponding receptacle and completing the unit with the aid of a closure that supports an applicator.

In the usual manufacturing process, the cosmetic applicators are instead manufactured and packed by a company that specializes in this. The packed cosmetic applicators are then supplied to the filling plant. The filling plant also receives, often from another source, cosmetic receptacles. The filling plant then fills the cosmetic receptacles with the cosmetic compound—which is generally manufactured according to a secret recipe—and then inserts the wiper and the cosmetic applicator into the cosmetic receptacle in order to then attach the closure for the cosmetic receptacle.

As a rule, cosmetic applicators do not have the format of a rugged bottle brush of the kind used to clean beverage containers. Instead, it they generally have the form of a structure that is 10 to 25 mm long and has a diameter of approximately 4 to 6 mm and are most often equipped with hundreds of filigree bristles. The bristles are thin and delicate.

Today, many applicator manufacturers still follow a procedure in which they drop cosmetic applicators that they have produced on the production line into a box and then they deliver the box contents of several hundred or thousand applicators in so-called "bulk" form to the filling company. This supply arrangement incurs only a small amount of packaging expense, the packaging can also be produced very efficiently, and the finished manufactured applicators need only be simply dropped into the box from the production line that transports them. At the same time, it is not uncommon for this type of supply in "bulk" form to cause problems at the filling plant.

On the one hand, there is the constantly recurring problem that the filigree bristles (which are rod-shaped structures whose length is many times greater than their maximum diameter so that the bristle tips can be reversibly deflected by an amount that corresponds to many times the maximum bristle diameter until the bristle finally snaps off or at least no longer stands all the way up again) of the relatively small applicators become damaged when an applicator has several hundred or thousand applicators on top of it in a box and is therefore subjected to corresponding compressive forces. It is not uncommon for the applicators at the bottom of a box to have deformed bristles, particularly if the box in question has been in intermediate storage for days or weeks instead of being used "just in time."

On the other hand, there are also the constantly recurring problems due to the fact that the applicators equipped with bristles catch on one another when they are just carelessly thrown into a box and transported in "bulk" form, not least due to the influence of the vibrations that are typical in the course of road or rail transport and the cargo handling that this involves. Because of this, difficulties arise at the filling plant, where it is necessary to be able to reliably pick up only individual cosmetic applicators in order to supply them to their further intended purpose.

Because of this, there has recently been a changeover to supplying high quality applicators not in "bulk" form, but rather as products that are individually inserted into corresponding sorting devices, either manually or using high quality industrial robots. In this connection, one selection means, for example, is a belt, which can be mechanically supplied to the filling system and on which the applicators are fastened at defined distances from one another so that they can be reliably picked up one after the other in order to equip the filled cosmetic receptacles. The equipping of such a belt, however, requires an undesirable amount of effort by the applicator manufacturer.

Even "individually inserting" applicators into sorting or holding devices—for example inserting them into cardboard packages with hollows for separately holding applicators or into cardboard bases for individual insertion of the applicators like artificial flowers that are "planted neatly in rows" in a bed by inserting them into it—is not a completely satisfactory solution because of the labor it entails.

The foregoing example of the related art and limitations related therewith are intended to be illustrative and not exclusive. Other limitations of the related art will become apparent to those of skill in the art upon a reading of the specification and a study of the drawings.

SUMMARY

Given this situation, it is an aspect of the invention is on the one hand to disclose a simplified transporting and packing method and on the other hand, to disclose a transporting and packing method that reliably prevents individual applicators from being deformed and also reliably prevents the applicators from getting caught on one another in a way that prevents them from then being separated by corresponding sorting devices so that they can be individually supplied to a corresponding equipping machine in an orderly fashion.

The invention is based on the fundamental concept that the cosmetic applicators and the associated wipers usually form a system, i.e. are matched to each other, and therefore are usually purchased from one and the same specialized manufacturer.

It is therefore suitable to no longer package the cosmetic applicators and the associated wipers each separately in "bulk" form in boxes in order to ship them to the filling plant, but instead to combine a cosmetic applicator with the associated wiper to form a cosmetic applicator unit already at the manufacturing plant, i.e. to insert the cosmetic applicator at least a certain distance into the wiper so that the wiper provides a protection similar to the sheath of a sword, which protects the cosmetic applicator during transport.

The protection thus provided is particularly advantageous in the subsequent transport in bulk form since it reliably prevents the individual applicators from catching on one another and prevents an undesirable deformation of their bristle sets (bulk: numerous identical cosmetic applicator units stowed in a box or a pouch). In some cases that are not entirely ruled out here, the protection achieved by this is also suitable if the cosmetic applicator units are packaged in an individually or separately held fashion so that such an embodiment is not a priori excluded from the scope of protection even though this is not a preferred method. In one embodiment, the cosmetic applicator is entirely contained in the wiper.

For a number of other intended uses, however, it is also entirely sufficient for the protection of the applicator if for the duration of the transport, the applicator is at least partially enclosed by the wiper, i.e. is only inserted a certain distance or a certain part of the way into the wiper so that the latter constitutes a belt or "abdominal band" around a goodly portion of the bristle set of the applicator in such a way that applicators that have come to rest directly on and/or next to one another in the bulk pile do not in any case catch on one another in an intensive fashion.

Ideally, the wiper and the associated applicator are matched to each other in that the respective wiper has a protecting section whose inner cross-section is dimensioned so that this protecting section of the wiper can contain the bristle set of the applicator part for a long time without leaving behind irreversible deformations in the bristle set when the bristle set is freed again. In this context, irreversible deformations are in particular deformations in which after 10 days of being continuously enclosed by the wiper, the bristles have been deformed and, within 2 minutes, do not right themselves again so that the deformation that they have previously suffered is essentially no longer visible to the naked eye.

In order to achieve this, the wipers according to the invention must often be embodied slightly differently from the way that is known in the wipers of the prior art. The wipers known from the prior art essentially deform the bristles of the applicator along their entire length when the applicator passes through the wiper, i.e. is temporarily contained in it.

Ideally, the invention is implemented using wipers in which the protective section, viewed in the insertion direction (i.e. viewed in the direction in which in later use, the applicator is inserted through the wiper and into the cosmetic receptacle), is situated behind the actual wiper lip. This protective section is then used to slide the wiper onto the cosmetic applicator for transport so that the actual wiper lip rests against the wand with an elastic pre-stressing force and engages the wand in a frictional, non-positive fashion. The protective section nevertheless contains most or at least part of the bristle set. In so doing, the protective section preferably overlaps the bristle set by far enough that the cosmetic applicator unit, when it is placed on a flat surface, rests on its handle or its closure cap at one end and rests on the wiper at the other end—while the bristle set does not rest on the above-mentioned flat surface.

Another big advantage of such a configuration is that it also provides very effective relief of the strain on the bristles, even inside the wiper. This is because the wiper, with the aid of the wand, holds the bristle set essentially in a central position inside the wiper so that the wiper does not deform the bristles by any more than the degree intended when, for example, the weight of the applicator units contained in the upper bulk pile presses against the free length of the wand and exerts a force that tends to push the wand in relation to the wiper that has been slid onto it.

Preferably, the inner cross section of the protective section, particularly when a wiper is used, as described above, is selected so that between the bristle set and the inner surface of the protective section, no friction is produced or only a slight friction is produced so that for the duration of the transport, the wiper is held in its provided position at least predominantly by the frictional contact between the wiper lip and the wand. This makes it possible to relieve much or even essentially all of the strain on the bristle set.

In another preferred exemplary embodiment, particularly in one in which the actual wiper lip of the applicator does not interact with the wand for the duration of the transport, the outer diameter of the bristle set and the inner diameter of the wiper are matched to each other so that preferably, only a shorter part of the region that makes up the wiper engages the bristles in the necessary frictional, non-positive way in order to hold the wiper on the applicator for the duration of the transport. By contrast, preferably the longer part of the wiper is dimensioned and matched to the bristles so that this part of the wiper, which is likewise part of said protective section of the wiper, does not exert any significant deforming forces on the bristle set while the bristle set of the applicator is protruding through the wiper for the duration of the transport, i.e. for a longer time (at least 10 days).

For this purpose, it is good if the progression of the inner cross-section of the protective section in the direction of the longitudinal axis of the wiper is adapted to the progression of the diameter of the bristle set in the direction of the longitudinal axis of the applicator. It can thus be useful for an applicator with a for example truncated cone-shaped bristle set, for purposes of the transport according to the invention, to be associated with a wiper whose inner cross-section in the direction of its longitudinal axis is likewise embodied in the shape of a truncated cone.

The materials of the wiper and of the bristle set of the applicator are suitably matched to each other. The materials are selected so that for the duration of the transport, no harmful diffusion from the wiper into the bristle set takes place despite the direct, long-lasting contact (at least 10 days) between the wiper and the bristle set.

This is particularly applicable when wipers are used that are particularly flexible and therefore contain softening agents. The material of the bristles must then be matched to this plastic of the wiper with its softening agent so that no harmful diffusion occurs here that would end up causing a deformation of the bristles.

It is particularly preferable if the transporting method according to the invention is also combined with a subsequent assembly method. Specifically, it has turned out to be particularly advantageous if the cosmetic applicator units are transported in the manner according to the invention to their destination at which they are assembled with the cosmetic receptacle (usually at the filling plant) and then the assembly of each wiper with the respective cosmetic receptacle takes place without first separating the wiper from the cosmetic applicator unit. This has the advantage that it is not necessary to take out and individually handle the applicators and wipers from the "bulk" pile. Instead, it is sufficient to take from the "bulk" pile a cosmetic applicator unit, which is composed of the applicator and the wiper that has been mounted on it, and then to insert both of them into the bottle neck and to fasten or press-fit the wiper there.

It is particularly possible to achieve an assembly if the cosmetic applicator unit has a handle that constitutes the closure of the associated cosmetic receptacle and the handle is used as a tool for pushing the wiper into the cosmetic receptacle. Ideally, the assembly takes place by grasping the cosmetic applicator unit, which is composed of the applicator and the wiper. Then the wiper is inserted into the neck of the cosmetic receptacle. Next, the wand to which the wiper is fastened is slid all the way through the wiper in the closing direction until the outer end surface of the wiper comes into contact with the handle. Then all that remains is for the handle to be pressed against the cosmetic receptacle in the closed position, which automatically also causes the wiper to be driven into the neck of the cosmetic applicator, preferably so that it locks in place there.

It is particularly ideal if the handle of the cosmetic applicator unit has a contact surface and a thread for screwing onto the cosmetic receptacle. Then the wiper only needs to have a collar that is adapted for this. Then the handle can be quickly screwed onto the cosmetic receptacle and the wiper is thus driven into the cosmetic receptacle until it is secured in the intended position.

The wiper that is preferably used according to the invention advantageously has a wedge-shaped or cone-shaped taper at its end oriented toward the interior of the receptacle in the properly installed state, which facilitates the insertion of the wiper into the neck of the cosmetic receptacle.

Although the first exemplary embodiment is explained in connection with an illustration of a wire core applicator, it should be noted from the start that the invention is even more meaningful for injection-molded applicators because injection-molded applicators—unlike wire core applicators—do not have a "chaotic" bristle set composed of bristles that are somewhat supported against one another, but instead usually have a number of bristles meticulously arranged in rows and accurately oriented in space and with such bristles, it is immediately unpleasing to the eye if in the course of the transport in bulk, local deformation of the in this case very delicate bristles has occurred, causing them to then protrude in unorthodox directions or even to be snapped off or "flattened."

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
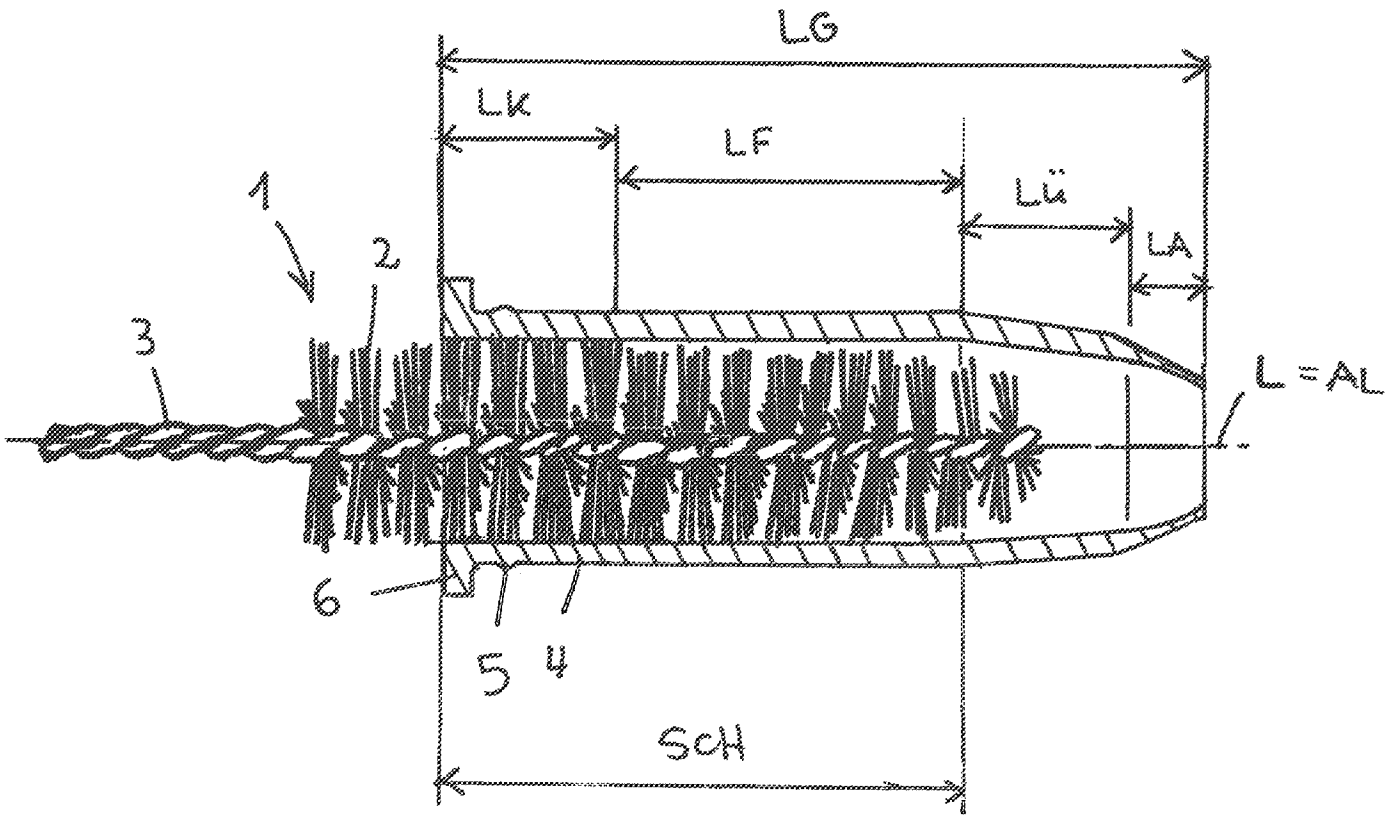
FIG. 1 shows a first exemplary embodiment of an applicator, which in this case is embodied in the form of a wire core applicator, in a sectional view along the longitudinal axis and is protruding into a wiper.

FIG. 1 shows a very enlarged view of a cosmetic applicator in the form of a mascara applicator. This is because basically, it is particularly preferable for the invention to be used in mascara applicators.

In this case, the applicator is embodied in the form of a so-called wire core applicator composed of at least two wires 3, which are twisted together and clamp the bristles 2 between themselves so that the bristles have an orderly, generally helix-like structure. In FIG. 1, it is quite clear that the inner diameter of the wiper 4 is matched to the outer diameter of the bristle set of the applicator 1.

As a rule, the applicator is connected via a wand that is not shown here to a handle or a cap, which is likewise not shown in the drawing here and thus together with the wand and the handle/cap. In some rather rare cases, the wand is omitted so that the cosmetic applicator is composed of only the handle/cap and the actual applicator. Most often, the handle simultaneously constitutes a cap for closing the cosmetic receptacle in a sealed fashion.

The wiper 4 has a protective section SCH whose inner diameter is dimensioned so that the bristle set of the applicator 1 can be slid into the protective section without suffering a permanent deformation.

It is advantageous, but not necessarily required, for the protective section SCH in turn to be divided into two separate sections, namely one section with the length LK and another section with the length LF.

Over the length LK, the inner diameter of the wiper is preferably selected so that it rubs the bristles of the applicator as the latter is inserted so that the applicator is held in the wiper with frictional, nonpositive engagement along the length LK of this section.

The part of the protective section that has the length LF, on the other hand, is advantageously embodied so that it has an inner diameter, which is large enough that the bristles of the bristle set do not positively engage with this section or do not positively engage with it to any appreciable degree so that the bristles that are situated in this section with the length LF are not deformed or are only deformed to a minimal degree.

Naturally, the above-described is merely an advantageous embodiment. Theoretically, it is naturally also possible for the protective section to engage with the bristle set in a frictional, non-positive way over its entire length—which in this case would be the entire length LK (while LF became zero)—in order to produce a particularly secure connection between the wiper and the bristle set.

Toward the distal end of the applicator (i.e. toward the end of the applicator oriented toward the handle), it is adjoined by an additional section of the wiper, which has the length LÜ and is referred to as the transition section. This transition section preferably has a conical progression of its outer diameter so as to facilitate insertion of the applicator into the neck of the bottle. And finally, the distal end of the wiper forms a section with the length LA, which is the actual wiping section.

Preferably, this section is particularly flexible at the length LA. This can be achieved, for example, in that the wall thickness decreases here in the way shown in the drawing. Alternatively, this can also be achieved in that in this case, for example, a soft elastic wiper lip is injection molded onto the wiper that is otherwise composed of a harder plastic.

In order to provide a protective section SCH that is long enough, the wipers according to the invention are preferably embodied as longer than the wipers that are known from the prior art. Preferably, the wipers according to the invention are embodied as long enough that the protective section makes up at least 40% or better still at least 60% of the length of the wiper in the direction of the longitudinal axis L.

As is clearly visible in FIG. 1, the wiper in this case is equipped with a collar-like section at its proximal end. The collar-like section serves to support it against a corresponding surface of the handle, not shown here, of the applicator. By means of this surface contact, the applicator can drive the wiper into the neck of the bottle.

In order to secure the applicator in the bottle neck, the applicator is preferably provided with a corresponding detent element. In the present case, this detent element is embodied in the form of a preferably continuous annular protrusion 5. In principle, however, it is conversely also possible for the detent element to also be embodied as an annular groove in the wiper, into which a corresponding ring or a plurality of ring-like elements of the bottle neck protrudes.

Figure 2:
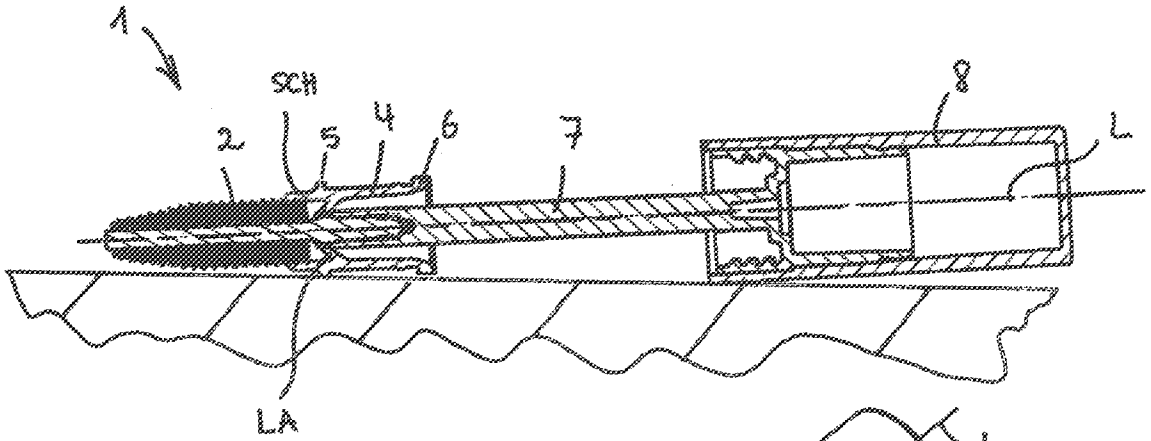
FIG. 2 shows a second exemplary embodiment of an applicator that is equipped with injection-molded bristles and is protected by a differently embodied wiper, in a sectional view along the longitudinal axis.

FIG. 2 likewise shows a cosmetic applicator embodied in the form of a mascara applicator. By contrast with the first exemplary embodiment, however, this mascara applicator is equipped with bristles that are injection-molded and are therefore particularly delicate.

It is particularly clear from FIG. 2 that the inner diameter of the wiper 4 is matched to the outer diameter of the bristle set of the applicator 1.

As a rule, the applicator is embodied by means of a wand 7 with a handle 8 and thus together with the wand and the handle.

As shown here, the handle 8 most often simultaneously constitutes a cap for closing the cosmetic receptacle in a sealed fashion.

The wiper 4 has a protective section SCH whose inner diameter is dimensioned so that the bristle set of the applicator 1 can be inserted into the protective section without suffering a permanent deformation. Ideally, the dimensions are even selected so that the protective section does not press against bristles or at least does not do so to any appreciable degree.

Figure 3:
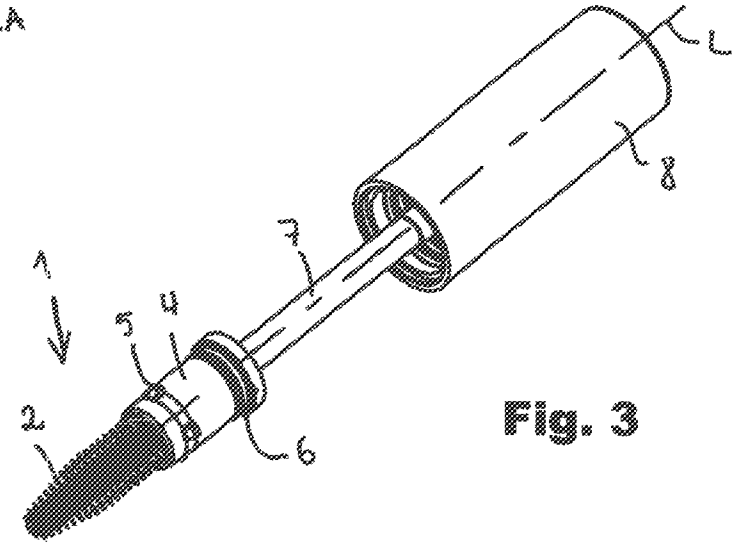
FIG. 3 shows a perspective view of the exemplary embodiment shown in FIG. 2.

FIGS. 2 and 3 show a wiper with a protective section SCH that has been kept quite short, but as clearly shown in FIG. 2, still fulfills its protective function. As is clear from the drawing, the cosmetic applicator unit, when it is placed on a flat surface F, rests on the flat surface with its handle at one end and with the wiper at the other. The bristle set itself does not come into contact with the flat surface and thus even when the applicator unit is stored in this position for an extended period of time, it cannot suffer any damage in the form of local "pressure points" or the like. Furthermore, such a configuration offers a not insignificant protection against two wipers, which come to rest directly against each other in the bulk pile, becoming interlocked with each other's bristles so intensively that they can no longer easily be separated—because it is quite rare for two applicators, when their longitudinal axes are oriented essentially parallel to each other, to really come to rest against each other with only their bristle sets. But in such an orientation, as soon as even a part of the bristle set of the one applicator comes to rest against the outer circumference surface of the wiper of the other applicator, the bristle sets can no longer come close enough to each other that an excessive "interlocking with each other" can be expected.

The wipers that are used for an exemplary embodiment like this are preferably also embodied to be long enough that the protective section SCH makes up at least 40% or better still at least 60% of the length of the wiper in the direction of the longitudinal axis L so that the bristle set is optimally protected, even from identical applicator units in the bulk pile resting on top of the bristle set.

It should also be noted that the wiper of the second exemplary embodiment can naturally also be used with the twisted wire core brush and vice versa. Particularly with applicators that have delicate injection-molded bristles, however, it is clearly preferable to use wipers of the kind shown in FIGS. 2 and 3.

After being transported in bulk form, the cosmetic applicator units are vibrated in vibratory feeder where they come to rest in a jumble. With the aid of corresponding baffles, the vibratory feeder brings the cosmetic applicator units, which are each protected from interlocking with each other by the wipers used according to the invention, into a trough so that they are correctly oriented one after the other—without requiring intervention by the machine operator who is usually actively involved in separating from one another cosmetic applicator units whose bristle sets have become hooked/caught in each other as a result of being transported in bulk so that they can no longer be separated from each other by vibration alone. In this way, the cosmetic applicator units arrive, correctly aligned one after the other, at chutes via which they slide into the neck of the receptacle, optionally assisted by a conveying air flow (vacuum tube principle) so that the wiper is pre-centered in the neck of the receptacle—for which it is particularly advantageous if the wiper is embodied as conical or tapered at its end that subsequently ends up inside the receptacle. For this reason, the sorting/separating of the cosmetic applicator units supplied in bulk form is not an arbitrary addition, but can instead optionally be an essential additional component of the method according to the invention.

The applicators can be attached by means of detent grooves and detent projections as shown in FIG. 1 or even by means of hooks, so to speak, that are optionally provided only in some locations and that engage behind the end of the receptacle neck, as shown in FIG. 2.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In general the terms and phrases used herein have their art-recognized meaning, which can be found by reference to standard texts, journal references and contexts known to those skilled in the art. The above definitions are provided to clarify their specific use in the context of the invention.

REFERENCE NUMERAL LIST

1 applicator
2 brush
3 wire core
4 wiper
5 detent element of the wiper
6 collar of the wiper
7 wand
8 handle/cap
Sch protective section
LG entire length of the wiper
LK section of the wiper over which the wiper engages with the bristle set in a frictional, nonpositive fashion
LF length of the section over which the protective section does not come into contact with the bristles 2—or does not come into contact with them to any significant degree
LÜ length of the wedge-shaped or conical transition section to facilitate insertion of the wiper into the neck of the bottle
LA actual wiper section
L longitudinal axis of the wiper and simultaneously the longitudinal axis of the applicator AL

I claim:

1. A method for assembling, storing and/or transporting cosmetic applicators, wipers, and cosmetic receptacles, the method comprising the steps of:

associating a wiper with a cosmetic applicator, wherein the cosmetic applicator has a handle, a wand attached to the handle, and a bristle set attached to the wand extending radially from the longitudinal axis of the cosmetic applicator, and the wiper has a wiper lip, a protective section, and a collar;

sliding the wiper at least partially over the bristle set of the cosmetic applicator to form a cosmetic applicator unit having the bristle set at least partially contained by the protective section of the wiper, wherein the inner cross-section of the protective section of the wiper tapers with the outer diameter of the bristle set along the longitudinal axis;

stowing the cosmetic applicator unit with a plurality of cosmetic applicator units in a container for storage and/or transport until assembly;

associating the cosmetic applicator unit with a cosmetic receptacle, wherein the cosmetic receptacle has a neck forming an opening, the neck configured to lock in the wiper and to couple to the handle of the cosmetic applicator;

aligning the wiper with the opening of the cosmetic receptacle;

sliding the wand of the cosmetic applicator through the wiper until the collar of the wiper contacts the handle of the cosmetic applicator; and coupling the neck of the cosmetic receptacle to the handle of the cosmetic applicator, thereby locking the wiper within the neck of the cosmetic receptacle.

2. The method of claim 1, wherein the inner cross-section of the protective section of the wiper is dimensioned to contain the bristle set of the cosmetic applicator without leaving behind significant, irreversible deformations in the bristle set when the bristle set is slid through the wiper.

3. The method of claim 1, wherein the protective section of the wiper, viewed in the insertion direction, is situated behind the wiper lip of the wiper, wherein the wiper lip rests with an elastic pre-stressing force against the wand of the cosmetic applicator to form a frictional, non-positive attachment therebetween after the wiper is slid over the bristle set of the cosmetic applicator to form the cosmetic applicator unit, and wherein the protective section overlaps the bristle set such that the cosmetic applicator unit rests on the handle at one end and on the wiper at the other end when the cosmetic applicator unit is placed on a flat surface.

4. The method of claim 3, wherein the inner cross-section of the protective section of the wiper is dimensioned to produce no friction or only a slight friction between the bristle set and the inner surface of the protective section in the configuration of the cosmetic applicator unit.

5. The method of claim 1, wherein the inner cross-section of the protective section of the wiper is dimensioned to produce friction between the bristle set and the inner surface of the protective section, such that the wiper is held securely against the bristle set in the configuration of the cosmetic applicator unit.

6. The method of claim 1, wherein the material of the wiper and the material of the bristle set are selected so that for the duration of storage and/or transport, no harmful diffusion from the wiper into the bristle set takes place despite direct, long-lasting contact between the wiper and the bristle set.

7. The method of claim 1, further comprising the step of transporting the plurality of cosmetic applicator units to a location for assembly with one or more cosmetic receptacles.

8. The method of claim 1, wherein the handle has a thread for screwing onto the cosmetic receptacle.

9. The method of claim 1, further comprising the step of feeding the plurality of cosmetic applicator units into a vibratory feeder to dispense at least one series of identically oriented cosmetic applicator units, before the step of associating the applicator unit with the cosmetic receptacle.

10. The method of claim 1, further comprising the step of moving the cosmetic applicator unit via a chute or tube to the cosmetic receptacle that the cosmetic applicator unit is associated with, wherein the alignment of the wiper with the opening of the cosmetic receptacle occurs via a pre-centering of the cosmetic applicator unit by the chute or tube.

11. The method of claim 10, wherein a conveying airflow in the chute or tube assists in moving the cosmetic applicator unit through the chute or tube.

* * * * *